US006322335B1

(12) United States Patent
Shi

(10) Patent No.: US 6,322,335 B1
(45) Date of Patent: Nov. 27, 2001

(54) PUMP STRUCTURE

(76) Inventor: Chi Wei Shi, No. 48-9, Chin Shun St., Chin Chung Village, Lu Chu Hsiang, Tao Yuan Hsien (TW)

( * ) Notice: Subject to any disclaimer, the term of this patent is extended or adjusted under 35 U.S.C. 154(b) by 0 days.

(21) Appl. No.: 09/624,505

(22) Filed: Jul. 24, 2000

(51) Int. Cl.[7] ..... F04B 17/00; F01D 5/00
(52) U.S. Cl. ..... 417/420; 417/365; 415/172.1
(58) Field of Search ..... 417/420, 365; 415/172.1, 174.3, 174.2, 173.3, 173.4

(56) References Cited

U.S. PATENT DOCUMENTS

| | | | | |
|---|---|---|---|---|
| 4,063,846 | * | 12/1977 | Eagle | 415/199.2 |
| 5,184,945 | * | 2/1993 | Chi-Wei | 417/420 |
| 6,200,090 | * | 3/2001 | Chien et al. | 415/172.1 |
| 6,234,748 | * | 5/2001 | Brown et al. | 415/170.1 |
| 6,264,440 | * | 7/2001 | Klein et al. | 417/420 |

FOREIGN PATENT DOCUMENTS 8-303388 * 11/1996 (JP) .

* cited by examiner

*Primary Examiner*—Charles G. Freay
*Assistant Examiner*—Michael K. Gray
(74) *Attorney, Agent, or Firm*—Pro-Techtor International Services

(57) ABSTRACT

A pump includes a front casing and a rear casing for defining a space therebetween. An end of the shaft extends into the space with an impeller is supported by a bushing which makes the impeller is rotatable in the space. A wearing ring is attached to a front side of the impeller. The front casing defines a bore in which a buffer is received so as to be axially movable with respect thereto. A thrust ring is attached to the buffer for contactingly engaging the wearing ring whereby when the impeller rotates, the axial movement of the buffer maintains a fluid film between the thrust ring and the wearing ring. An O-ring is mounted to the buffer for providing a buffer function between the buffer and the bore thereby helping maintaining the fluid film.

2 Claims, 4 Drawing Sheets

PUMP STRUCTURE

FIELD OF THE INVENTION

The present invention generally relates to a pump, and in particular to a pump structure comprising a movable, dynamic and auto-adjustable thrust ring assembly for extending service life of the pump.

BACKGROUND OF THE INVENTION

A conventional pump, as shown in FIG. 5 of the attached drawings, comprises a front casing 100 attached to a rear casing 200 to define an interior space 101 for accommodating an impeller 300. The impeller 300 is supported by a shaft and driven by a motor to rotate in the interior space 101. A trust 500 is fixed in an inside surface of the front casing 100. A wearing ring 400 is attached to the impeller 300 for contactingly engaging the thrust ring 500. Since there is always essential clearance between the shaft and bushing, the rotation of the impeller 300 is unavoidably an eccentric motion. This causes a non-uniform engagement between the thrust ring 500 and the wearing ring 400, leading to breakage of lubrication film therebetween and eventually shorting the service life time of wearing ring 400.

Thus, it is desired to provide a pump structure for overcoming the problems.

SUMMARY OF THE INVENTION

Accordingly, an object of the present invention is to provide a pump structure wherein the wearing of a wearing ring of an impeller is reduced hereby extending service life thereof.

Another object of the present invention is to provide a pump structure comprising an axially movable buffer, the orientation of which being capable to vary with the wearing ring of the impeller, while an eccentric motion occurs thus forming a face-to-face touch between the rings,by the way, the buffer also used to reduce the impact force acted by the impeller onto the thrust ring.

In accordance with the present invention, the pump of the present invention combining a front casing and a rear casing for defining a space therebetween. An end of the shaft extends into the space with an impeller is supported by a bushing which makes the impeller is rotatable in the space. A wearing ring is attached to a front side of the impeller. The front casing defines a bore in which a buffer is received so as to be axially movable with respect thereto. A thrust ring is attached to the buffer for contactingly engaging the wearing ring whereby when the impeller rotates, the axial movement of the buffer facilitates maintaining a fluid film between the thrust ring and the wearing ring. An O-ring is mounted to the buffer for providing a buffering function between the buffer and the front casing. This reduces the impact force.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
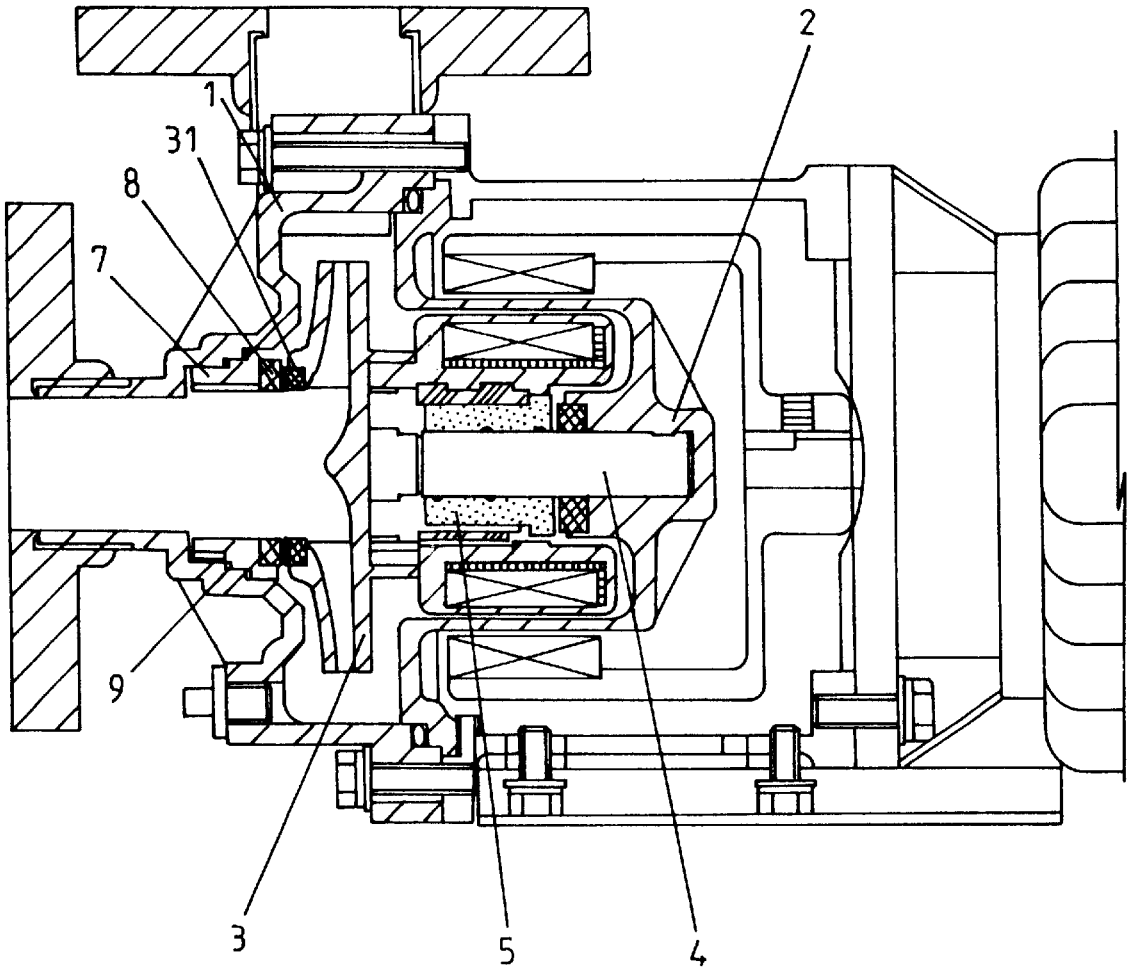
FIG. 1 is a cross-sectional view of a pump constructed in accordance with the present invention with a motor coupled thereto.

With reference to the drawings and in particular to FIG. 1, wherein a pump constructed in accordance with the present invention is shown, the pump of the present invention comprises a rear casing 2 to which a front casing 1 is attached for defining an interior space (not labeled). A shaft 4 is restrained the rear casing 2 and supported by a rear casing 2. An end of the shaft 4 extends into the interior space defined by the front casing 1 with an impeller 3 is supported by a bushing 5 which makes the impeller 3 is rotatable within the interior space, due to necessary clearance between the shaft 4 and bushing 5.

Figure 3:
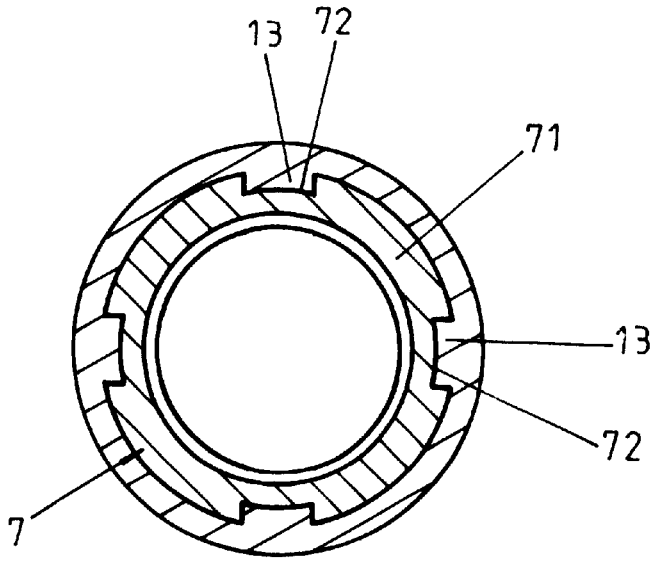
FIG. 3 is a front view of the pump of the present invention.
Figure 2:
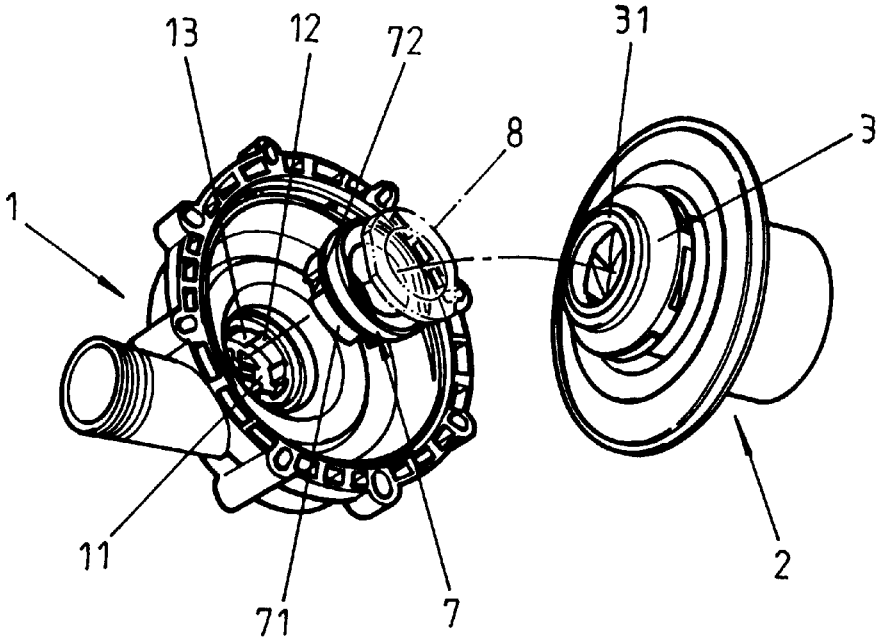
FIG. 2 is a perspective view of the pump of the present invention with a front casing detached therefrom.
Figure 4:
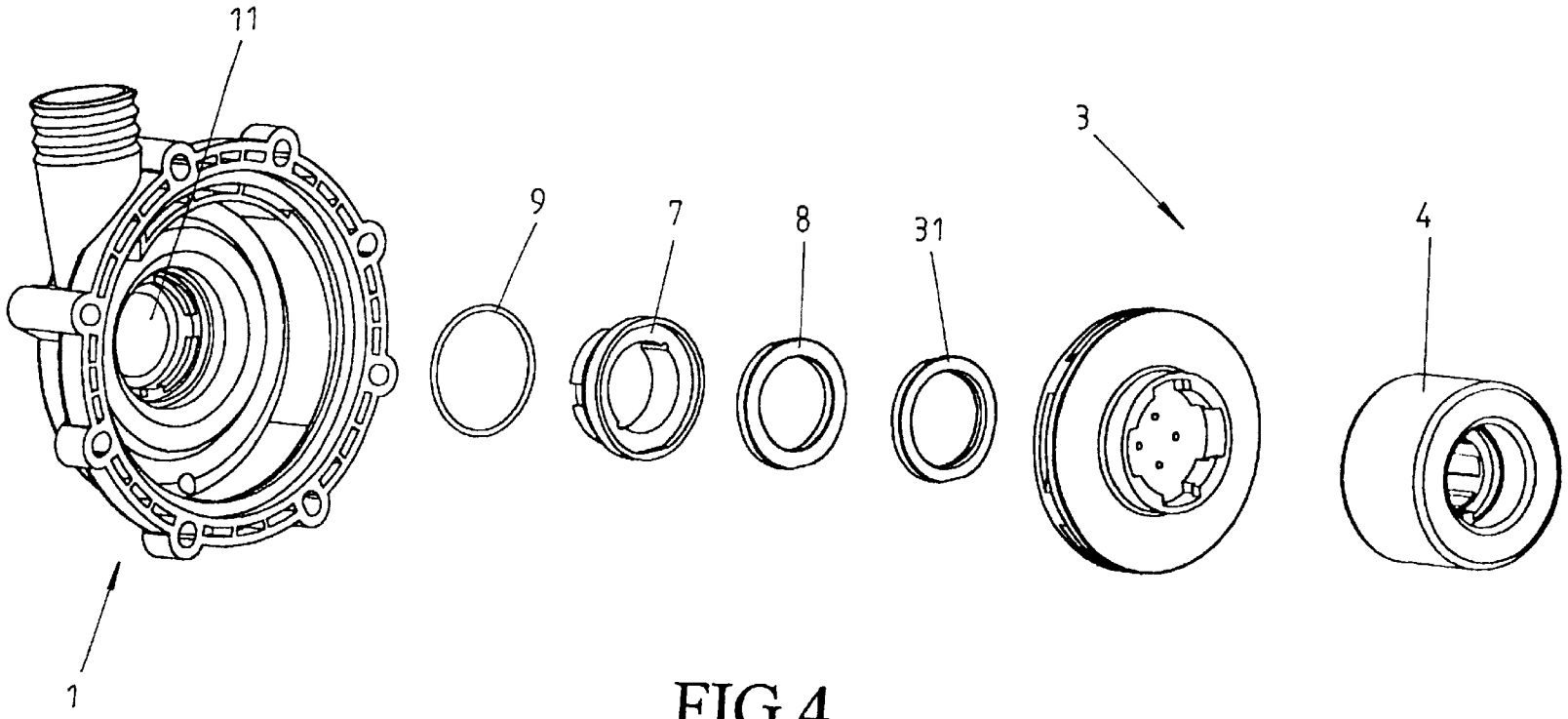
FIG. 4 is an exploded view of the pump of the present invention.
Figure 5:
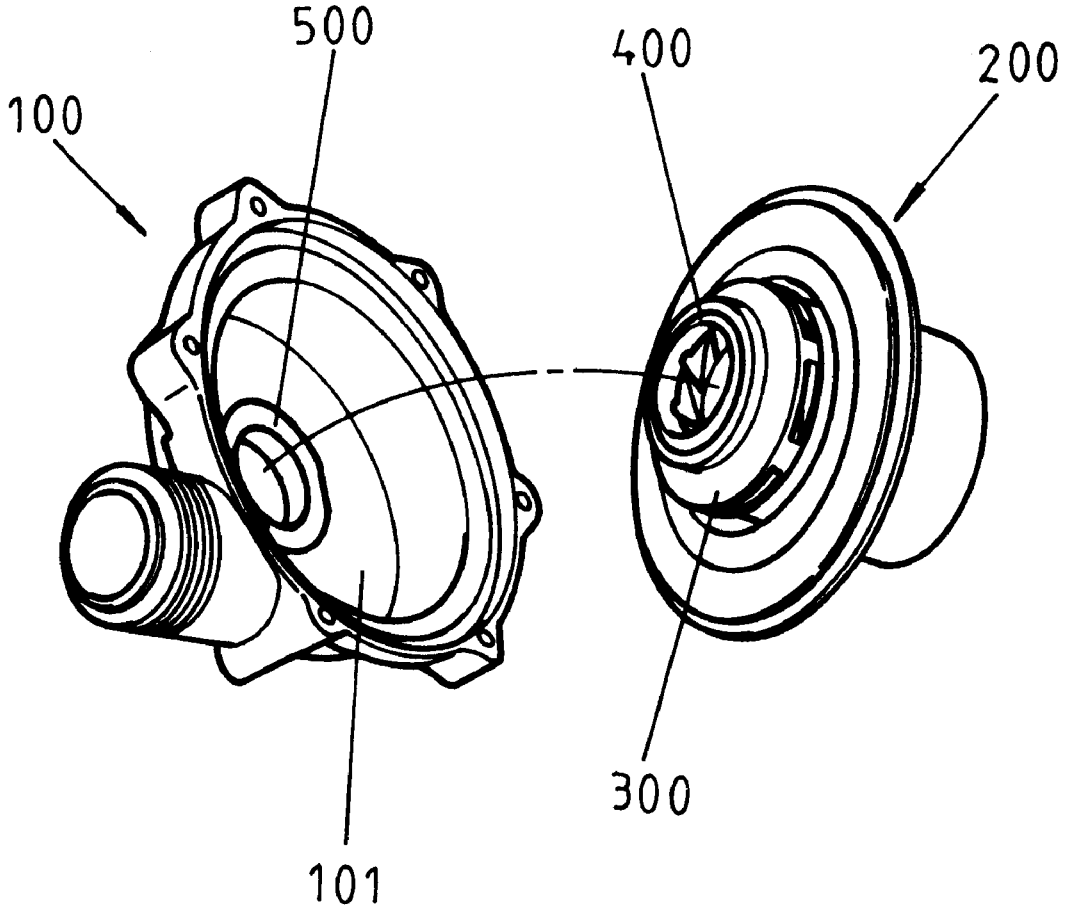
FIG.5 (PRIOR ART)
FIG. 5 is a perspective view of a conventional pump with a front casing detached therefrom.

Also referring to FIGS. 2–4, a bore 11 is defined in the front casing 1. A buffer 7 having a substantially ring-like configuration is received in the bore 11. The buffer 7 forms angularly spaced retaining projections 71 defining retaining recesses 72 therebetween. Angularly spaced projections 13 are formed along a circumference of the bore 11 defining recesses 12 therebetween. The buffer 7 is received in the bore 11 in such a way that the retaining projections 71 of the buffer 7 are received in the recesses 12 of the front casing 1 and the projections 13 of the front casing 1 are received in the retaining recesses 72 of the buffer 7 as shown in FIG. 3 for retaining the buffer 7 in the bore 11, while allowing axial movement of the buffer 7 with respect to the front casing 1.

A thrust ring 8 is attached to an end face of the buffer 7 that opposes the impeller 3 whereby when the front casing 1 is mounted to the rear casing 2, a wearing ring 31 that is mounted to a front side of the impeller 3 engages the thrust ring 8. Since the buffer 7 is axially movable with respect to the front casing 1, when the impeller 3 rotates, a surface contact, rather than a point contact, may be formed between the thrust ring 8 and the wearing ring 31 of the impeller 3. Furthermore, an O-ring 9 is mounted to the buffer 7 for buffering between the buffer 7 and the front casing 1. By means of the surface contact between the thrust ring 8 and the wearing ring 31 and the buffering function provided by the O-ring 9, fluid film formed between the wearing ring 31 and the thrust ring 8 may be properly maintained thereby reducing wear of the wearing ring 31 and extending service life thereof.

Although the present invention has been described with respect to the preferred embodiment, it is contemplated that a variety of modifications, variations and substitutions may be done without departing from the scope of the present invention that is intended to be defined by the appended claims.

What is claimed is:

1. A pump comprising a front casing and a rear casing for defining a space therebetween, an end of a shaft extending into the space with the shaft being supported by a bushing, an impeller connecting to the shaft is rotatable within the space, a wearing ring being attached to a front side of the impeller, the front casing defining a bore, the improvement comprising:

a buffer received in the bore and being axially movable therein;

an O-ring being mounted to the exterior of the buffer;

a thrust ring being attached to the buffer for contactingly engaging the wearing ring whereby when the impeller rotates, the axial movement of the buffer facilitates maintaining a fluid film between the thrust ring and the wearing ring.

2. The pump as claimed in claim 1, wherein the buffer forms first projections angularly spaced from each other and defining first recesses therebetween and the front casing forms second projections angularly spaced along a circumference of the bore defining second recesses therebetween, the buffer being received in the bore in such a way that the first projections are received in the second recesses and the second projections are received in the first recesses.

* * * * *